US006254442B1

(12) United States Patent
Suzuki

(10) Patent No.: US 6,254,442 B1
(45) Date of Patent: Jul. 3, 2001

(54) WATERCRAFT PROPULSION SYSTEM

(75) Inventor: Akitaka Suzuki, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/183,529

(22) Filed: Oct. 30, 1998

(51) Int. Cl.[7] ..... B63H 11/00
(52) U.S. Cl. ..... 440/38; 440/84; 123/192.2
(58) Field of Search ..... 440/75, 83, 84, 440/88, 89; 123/192.2; 464/179, 180

(56) References Cited

U.S. PATENT DOCUMENTS

| | | | | |
|---|---|---|---|---|
| 3,903,995 | * | 9/1975 | Irgens | 184/27 |
| 4,028,963 | * | 6/1977 | Nakamura et al. | 74/604 |
| 4,377,992 | * | 3/1983 | Zeilinger et al. | 123/192 B |
| 4,802,450 | * | 2/1989 | Roberts | 123/192 B |
| 5,044,333 | * | 9/1991 | Fuchigami et al. | 123/192.2 |
| 5,282,444 | * | 2/1994 | Ito et al. | 123/192.2 |
| 5,542,387 | * | 8/1996 | Okubo | 123/192.2 |
| 5,715,784 | * | 2/1998 | Okui et al. | 123/192.2 |
| 5,846,102 | * | 12/1998 | Nitta et al. | 440/1 |
| 5,885,121 | * | 3/1999 | Nanami et al. | 440/88 |
| 5,967,861 | * | 10/1999 | Ozawa et al. | 440/1 |
| 6,006,715 | * | 12/1999 | Izumi et al. | 123/192.2 |
| 6,017,255 | * | 1/2000 | Nanami | 440/89 |
| 6,030,263 | * | 2/2000 | Uchino et al. | 440/89 |
| 6,067,950 | * | 5/2000 | Kinoshita et al. | 123/192.2 |

FOREIGN PATENT DOCUMENTS

| | | | | |
|---|---|---|---|---|
| 3903419 | * | 9/1989 | (DE) | 123/192.2 |
| 1001077 | * | 11/1965 | (GB) | 123/192.2 |
| 775046 | * | 8/1999 | (GB) | 123/192.2 |
| 53-125506 | * | 11/1978 | (JP) | 123/192.2 |
| 3-70823 | * | 3/1991 | (JP) | 123/192.2 |
| 3-81529 | * | 4/1991 | (JP) | 123/192.2 |
| 7-237586 | * | 9/1995 | (JP) | 440/89 |
| 9-48393 | * | 2/1997 | (JP) | 440/88 |
| 11-91684 | * | 4/1999 | (JP) | 440/88 |
| 11-208582 | * | 8/1999 | (JP) | 440/88 |

* cited by examiner

*Primary Examiner*—S. Joseph Morano
*Assistant Examiner*—Ajay Vasudeva
(74) *Attorney, Agent, or Firm*—Ernest A. Beutler

(57) ABSTRACT

Several embodiments of personal watercraft having very compact construction, in particularly embodying a compact propulsion system wherein the engine and a number of its accessories all define a very compact area. A balance shaft is driven by the engine crankshaft for reducing the transmission of vibrations to the watercraft riders.

7 Claims, 6 Drawing Sheets

WATERCRAFT PROPULSION SYSTEM

BACKGROUND OF THE INVENTION

This invention relates to a personal watercraft and more particularly to an improved propulsion system and balancing arrangement for such watercraft.

Personal watercraft represent a very rapidly growing segment of the total watercraft market. Although personal watercraft have a wide variety of features and configurations, they have in common the fact that they are designed primarily to have a hull that is quite small and which accommodates a rider and no more than a few additional passengers. Frequently, but not always, the rider and passenger sit on a straddle type seat and in tandem fashion. With this type of watercraft, the riders' area is generally positioned at the rear of the watercraft.

This type of watercraft is also commonly propelled by a so-called "water jet propulsion unit" that is generally mounted in the hull under surface at the rear of the watercraft and generally underline the rearward portion of the riders' area.

This type of construction, particularly in a small watercraft, provides a significant rearward weight bias. Therefore, it is desirable and has been the practice to mount the engine for the propulsion device in a generally forward position and so that it lies at least in part beneath the forward portion of the riders' area. Thus, the center of balance of the watercraft can be optimized and can accommodate varying numbers of riders without the balance being significantly upset.

This gives rise, however, to a problem in connection with the transmission of vibrations and noise to the rider and his passengers. This is particularly true when the engine has only a few cylinders and the space limitations or other factors may not permit full engine balancing by the engine crankshaft alone.

It is, therefore, a principle object of this invention to provide an improved propulsion system for a watercraft of the personal type which will have a compact nature and which will maintain good balance and elimination or reduction of the transmission of noise and vibrations to the riders.

It is a further object of this invention to provide an improved and compact, low vibration propulsion system for a personal watercraft.

SUMMARY OF THE INVENTION

The feature of this invention is adapted to be embodied in a personal watercraft and propulsion system therefor. The personal watercraft is comprised of a hull that defines a rider's area at the rear thereof for accommodating a rider and a minimum number of passengers. A jet propulsion system is supported in the hull at the rear end thereof and at least in substantial part beneath the riders' area. An internal combustion engine is supported within the hull at a position disposed forwardly of the jet propulsion unit and at a position that is at least in part below the forward portion of the riders' area. The engine has a plurality of cylinders and a crankshaft driven by pistons that reciprocate in the cylinders and which is defined an engine body. The engine drives the jet propulsion unit through a transmission system. A balance shaft is driven from the engine crankshaft and contained within the engine body for reducing the transmission of noise and vibrations to the riders

DETAILED DESCRIPTION OF THE PREFERRED EMBODIMENTS OF THE INVENTION

Figure 1:
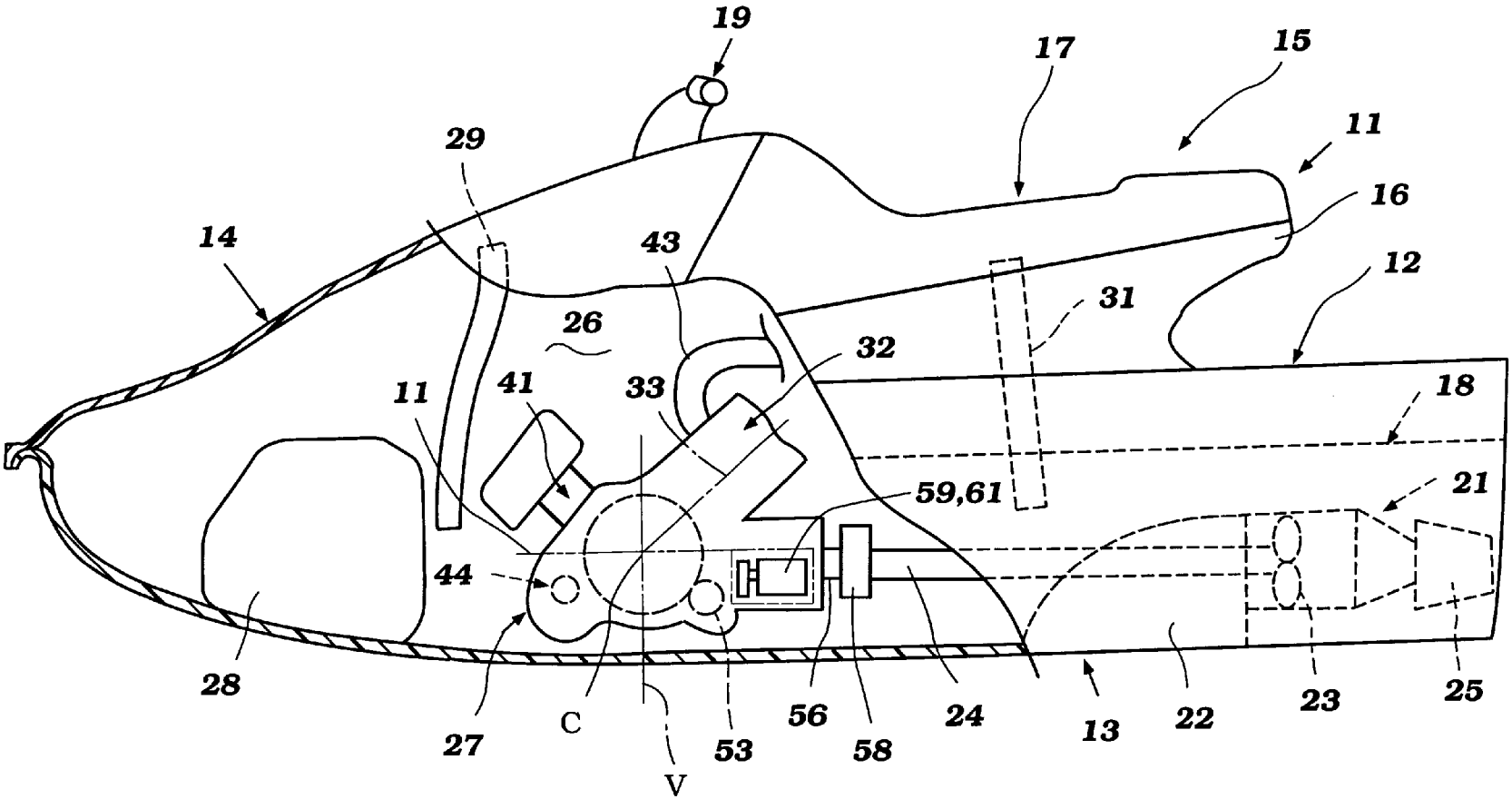
FIG. 1 is a side elevational view of a personal watercraft having a propulsion unit constructed in accordance with a first embodiment of the invention, with portions of the hull broken away so as to more clearly show the orientation of the engine and its accessories in the watercraft.
Figure 2:
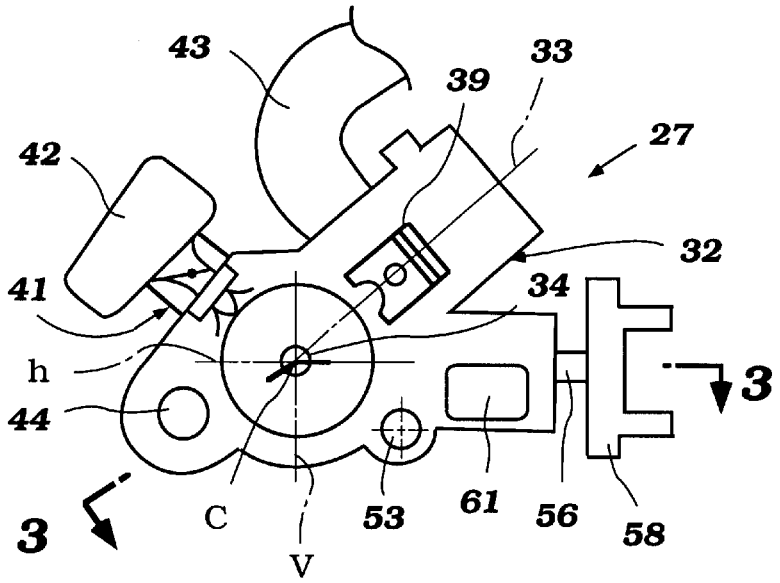
FIG. 2 is a side elevational view looking in the same direction as FIG. 1 and shows only the engine and additional portions of the engine in schematic cross-section.
Figure 3:
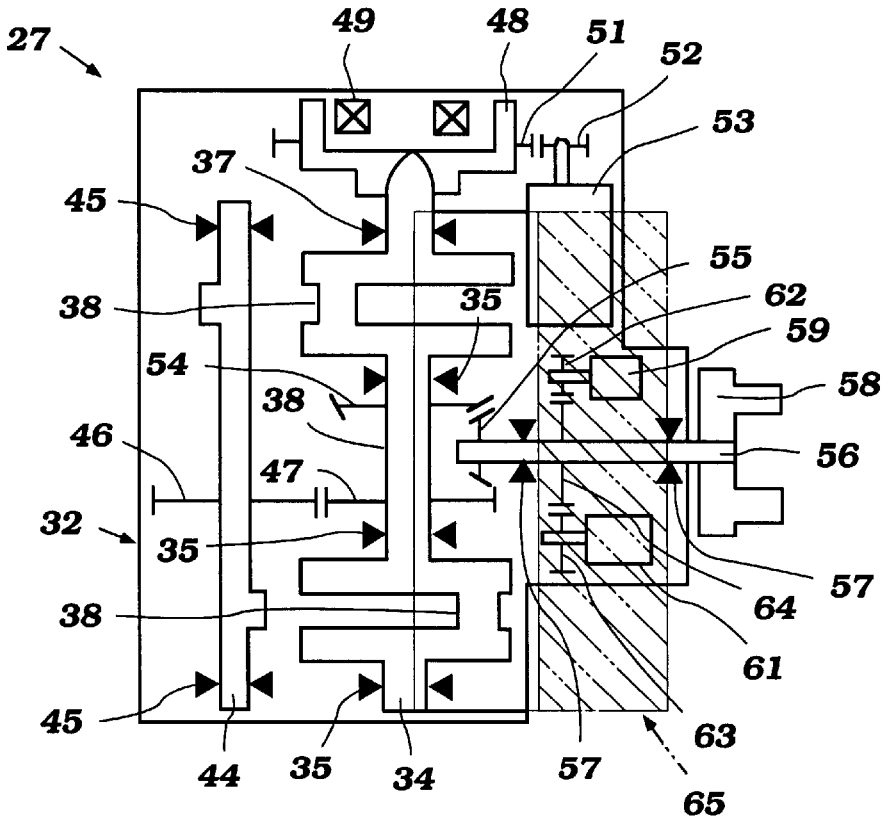
FIG. 3 is a schematic, cross-sectional view taken generally along the line 3—3 of FIG. 2.

Referring now in detail to the drawings and initially to the embodiment of FIGS. 1–3, a small personal watercraft constructed and propelled by a propulsion device embodying the invention is indicated generally by the reference numeral 11. As has been aforenoted, the personal watercraft 11 is of a type that is designed to be operated primarily by a rider and is designed to carry one or more additional passengers, although the number to be accommodated is relatively small. In this particular instance, the total maximum number of occupants of the riders' area of the watercraft 11, is approximately three. Also, the particular configuration of the riders' area, which will be described, is to be considered to be only typical of one of many types of configurations that are used and which are typical with this type of watercraft and with which the invention may be practiced.

The watercraft 11 is comprised of a hull assembly, indicated generally by the reference numeral 12 which is comprised of a hull under part 13 and a deck portion 14. The hull portions 13 and 14 are formed from a suitable material, such as a molded, fiberglass reinforced resin or the like, and are secured together in any suitable manner.

The deck portion 14 defines at the rear end thereof a riders' area, which has been previously referred to and which is indicated generally by the reference numeral 15. This is comprised of a raised pedestal part 16 on which a removable seat cushion part 17 is detachably supported. The seat 17 is sized so as to accommodate the aforenoted operator and one or more riders who are seated in straddle cabin fashion. The riders feet are placed in foot areas 18 disposed on opposite sides of the pedestal part 16.

A control mast 19 is disposed forwardly of the seat 17 for control of the watercraft by the rider operator in a well known manner.

The hull 12 defines an undersurface in which a jet propulsion unit, indicated generally by the reference numeral 21 is mounted. The jet propulsion unit 21 is mounted toward the rear of the riders' area 15 and on the underside of the hull portion 13 at the rear of the watercraft.

As is typical, the jet propulsion unit 21 includes an outer housing that defines a downwardly facing water inlet portion 22 through which water may be drawn for propulsion of the watercraft 11. This water is drawn by an impeller 23 that is journaled within the outer housing of the jet propulsion unit 21 and which is driven by an impeller shaft 24 that extends forwardly beneath the riders' area 15.

A steering nozzle 25 is journaled for steering movement about a vertically extending axis at the end of the jet propulsion unit outer housing. By pivoting this steering nozzle 25 about this axis through operation of the control mast 19, the watercraft may be steered in a manner well known in the art.

An engine compartment 26 is formed by the hull and deck portions 13 and 14 generally forwardly of the jet propulsion unit 21 and in substantial part beneath the forward portion of the riders' area 15. A propulsion drive unit, indicated generally by the reference numeral 27, is mounted within this engine compartment 26 rearwardly of a fuel tank 28 for driving the jet propulsion unit 21 in a manner which will be described.

The engine compartment 26 is ventilated by a ventilating air inlet pipe 29 mounted at the front thereof and which draws atmospheric air for circulation through the engine compartment 29. A discharge vent pipe 31 extends upwardly from the rearward portion of the engine compartment 26 and beneath the seat 17 for discharge of the ventilating gases back to the atmosphere.

The invention deals primarily with the construction of the propulsion drive unit 27 and its balancing. This construction may be best understood by reference additionally to FIGS. 2 and 3.

The propulsion unit 27 in this embodiment is comprised of a two cylinder in-line type engine operating on a two stroke crankcase compression principle. It is to be understood, of course, that the invention can be utilized with other types of engines. However, the invention has particular utility with engines of this type and particularly engines that employ balance shafts, for reasons which will become apparent.

The engine is comprised of a cylinder block assembly 32 that has two in-line cylinder bores that lie on a common plane 33 which is inclined at an acute angle to a horizontal plane H passing through the center of rotation C of a crankshaft 34 that is journaled within a crankcase chamber as shown somewhat schematically in FIG. 3. A vertical plane V passes through the axis of rotation C. The cylinder bore axes common plane 33 is inclined at a rearward acute angle to this vertical plane V.

The crankshaft 34 is supported by a plurality of longitudinally spaced main bearings which are shown schematically at 35 and which are basically positioned at the ends of the crankshaft 34 and between the throws 38 thereof. In order to maintain a relatively low height for the engine, the crankshaft 34 itself is not fully balanced.

Pistons 39 reciprocate in the respective cylinder bores and are connected by connecting rods which are not shown, but which can have any known type of conventional structure, to the crankshaft throws 38 for driving it for rotation about the axis C. As noted, this axis C extends transversely to the vertically extending plane V that intersects the horizontal plane H and which is disposed beneath the forwardmost end of the riders' area 15. The engine 27 is accessible for servicing through an access opening in the deck portion 14.

The basic construction of the components of the engine which are conventional are not illustrated as those skilled in the art will readily understand how the invention can be practiced. However, the layout of the accessory drives and drive for driving the impeller shaft 24 and the balancing of the engine are important and these will be described.

As is typical with two cycle crankcase compression engine practice, an induction system, indicated generally by the reference numeral 41, is provided for supplying at least an air charge to the crankcase chambers associated with each of the cylinder bores in which the pistons 39 reciprocate. The crankcase assembly is arranged so that each chamber section associated with a cylinder bore is sealed from the other. This induction system 41 includes an air inlet device 42 that draws air from within the engine compartment 26 and specifically air that is admitted by the ventilating pipe 29.

As is well known in two cycle practice, the intake charge is compressed in the crankcase chambers and then transferred to the combustion chambers formed above the heads of the pistons 39 by a cylinder head assembly that is affixed to the cylinder block 32 through scavenged passages. The charge is ignited by spark plugs which are not shown, and then discharged through an exhaust system which is shown partially and indicated by the reference numeral 43. This exhaust system 43 may include one or more water trap devices and discharges the exhaust gases to the atmosphere.

A balance shaft 44 is rotatably journaled within the crankcase chamber by spaced bearings 45 to balance any remaining engine vibrations. A drive gear 46 is affixed to the balance shaft 44 and is driven by a balance shaft drive gear 47 that is formed on one side of one throw of the right side throw 38 of the crankshaft 34. In the illustrated embodiment, the balance shaft 44 is driven at the same speed but in the opposite direction as the crankshaft 34 by this timing arrangement. This construction is all contained within a engine main body that includes the cylinder block 32.

A flywheel 48 is affixed to one end of the crankshaft 34. This flywheel has associated with it a flywheel magneto assembly 49 that generates electricity for charging a battery and/or for firing the ignition circuit afore-referred to for the spark plugs.

In addition, a starter gear 51 is affixed to the peripheral edge of the flywheel 48. A starter pinion 52 associated with a starter motor 53 engages the starter gear 51 for electrical starting of the engine. The starter motor 53 is also contained within the engine body that includes the cylinder block 32.

On the inner side of the left hand throw 38 of the crankshaft and spaced from the balance shaft drive gear 47 there is provided a bevel gear 54. This bevel gear 54 is enmeshed with and drives a driven bevel gear 55 that is fixed to an engine drive shaft 56. This engine drive shaft 56 is mounted within the engine body that includes the cylinder block 32 by means of spaced bearings 57.

A coupling 58 is affixed to the exposed end of the drive shaft 56 and affords an elastic coupling to the forward end of the impeller shaft 24 as shown best in FIG. 1. Thus, the length of the engine in the engine compartment can be substantially reduced by placing the engine 27 in a transverse position with the cylinder bores inclined to the rear. This maintains the center of gravity for the watercraft in the desired location.

A pair of engine accessories comprised of an oil pump 59 and a fuel pump 61 are mounted in the engine body that includes the cylinder block 32 on opposite sides of the drive shaft 56. These accessories have affixed to their input shafts drive gears 62 and 63 which are enmeshed with a drive gear 64 that is affixed to the drive shaft 56. This connection is also provided within the engine body that includes the cylinder block 32. Furthermore, these accessories lie within a shaded area indicated at 65 in FIG. 3 which lies below the cylinder block 32. Thus, the compact arrangement is maintained and these components will be protected but also accessible.

Figure 4:
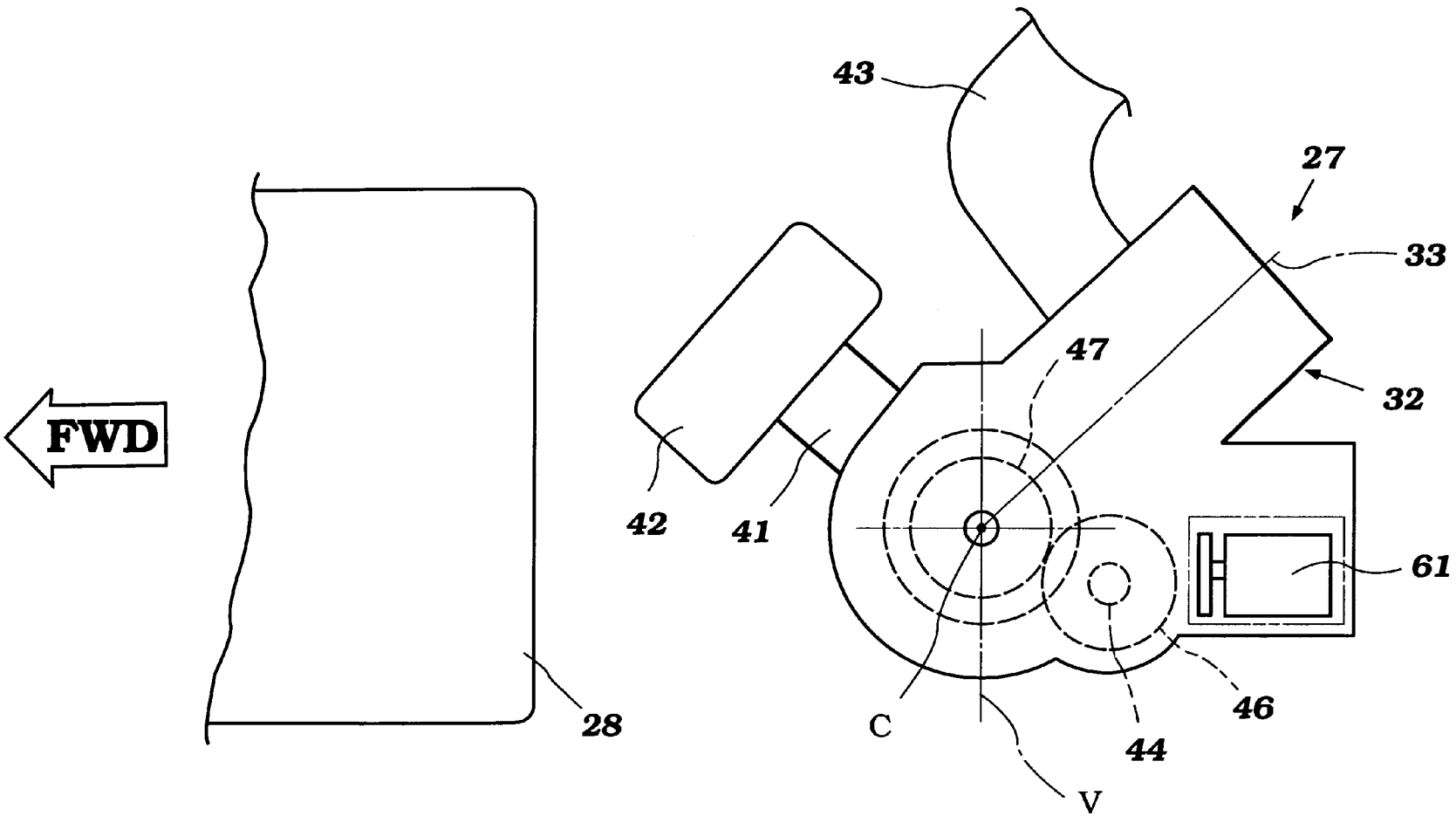
FIGS. 4 is a partial view, in part similar to FIG. 1 and looking in the same direction, but showing a second embodiment of the invention.

FIG. 4 is a partial view that is in part similar to FIGS. 1 and 2 and shows an embodiment where the engine can be made even more compact by locating the balance shaft 44 and its axis to the rear of the crankshaft 34 and below the engine output shaft 56.

Figure 5:
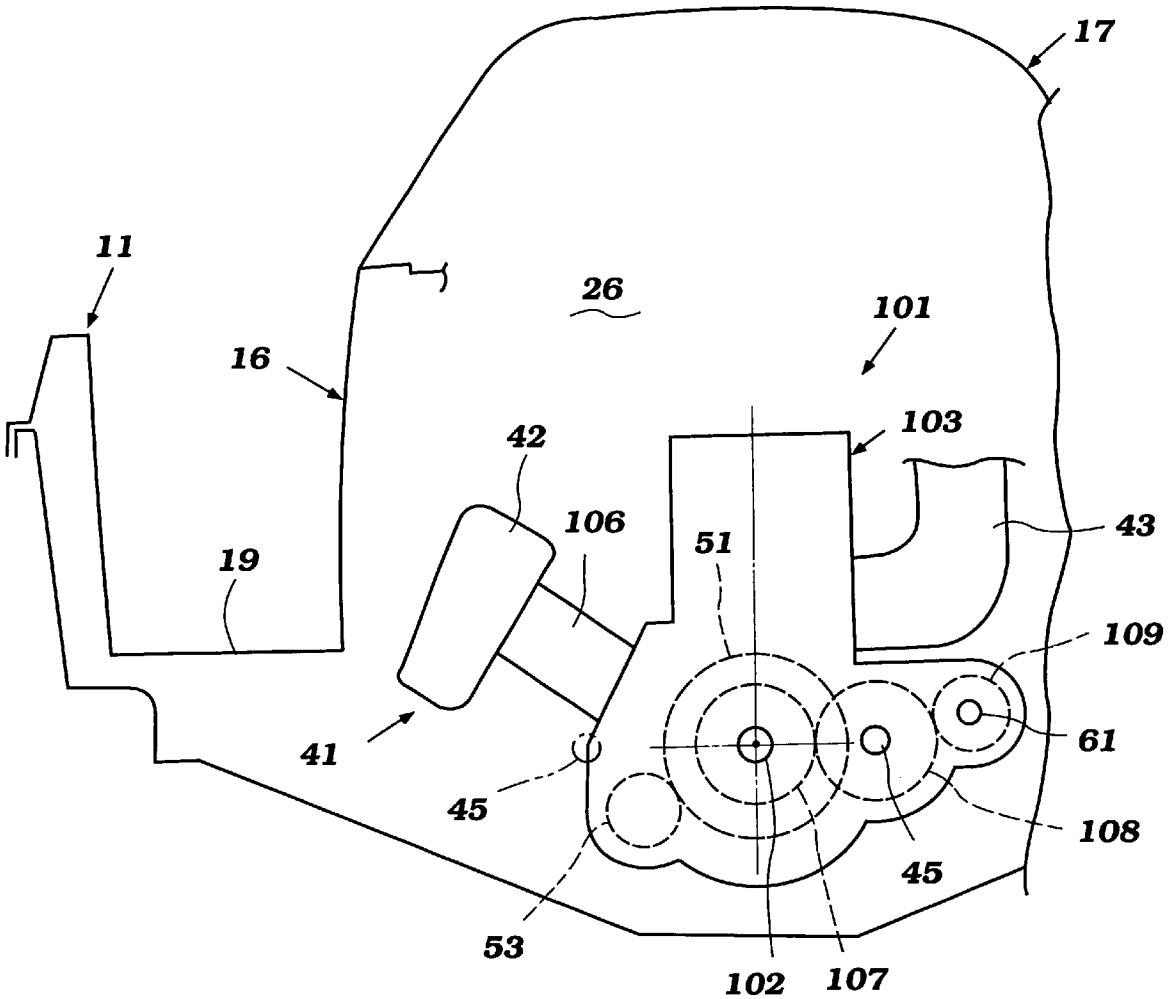
FIG. 5 is a transverse cross-sectional view taken through a personal watercraft constructed in accordance with a third embodiment of the invention.
Figure 6:
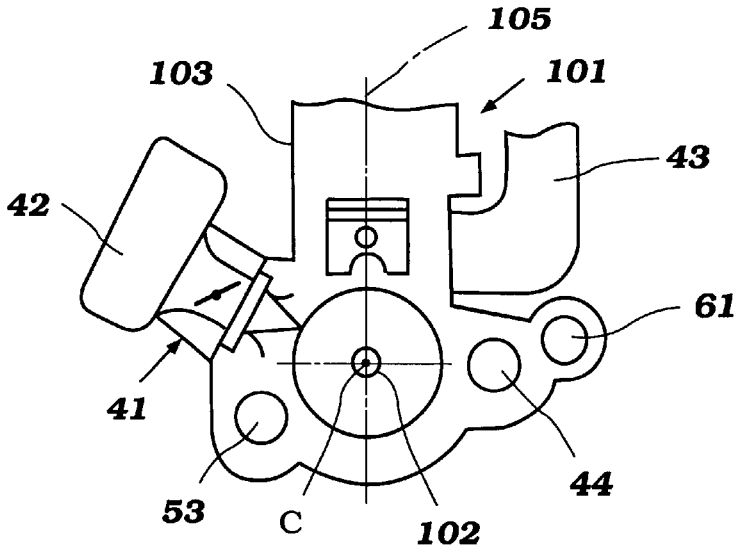
FIG. 6 is a view of the engine of this embodiment looking in the same direction as FIG. 5 and is, in part, similar to FIG. 2 in that it shows additional of the internal components of the engine in schematic cross-section.
Figure 7:
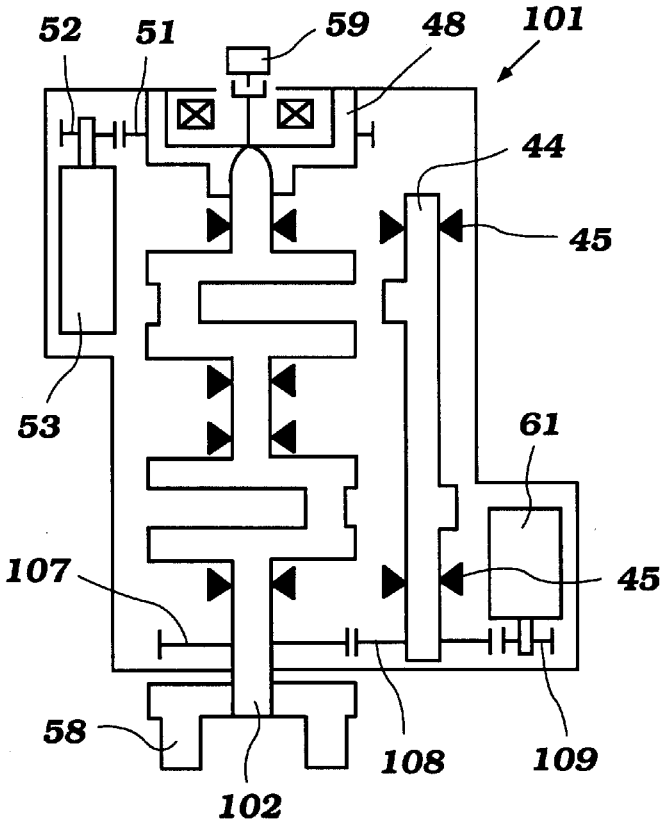
FIG. 7 is a cross-sectional view taken along the line 7—7 of FIG. 6 and thus is, in part, similar to FIG. 3.

FIGS. 5–7 show another embodiment of the invention which is generally the same as the embodiment of FIGS. 1–3, except for the construction of the engine propulsion unit, indicated generally by the reference numeral 101, and its orientation within the engine compartment 26. Because of the similarities of certain components to the embodiments thus far described, where those components are the same, they have been identified by the same reference numerals and will not be described again, except insofar as it is necessary to understand the construction and operation of this embodiment.

The primary difference between this embodiment is that the power unit 101 is disposed so that its crankshaft, indicated generally by the reference numeral 102, rotates about a longitudinally extending axis, also indicated at C, which is generally aligned with a longitudinal center plane of the watercraft hull 12. The engine 101 again has an engine body 103 which includes a cylinder block portion that defines two aligned cylinder bores in which pistons 104 are mounted. The axis 105 of the cylinder bores is vertically disposed in this embodiment.

In this embodiment, the drive coupling 58 for coupling to the drive shaft is directly affixed to the rear end of the crankshaft 102. The flywheel magneto assembly 48 is again fixed to the opposite, in this case front end of the crankshaft. Thus the starter motor 53 has a pinion gear 52 that cooperates with a ring gear 51 fixed to the flywheel magneto assembly.

In this embodiment, however, the oil pump 59 is directly driven off of the nose end of the crankshaft 102.

As may be seen, the induction system 41 is disposed at one side of the engine with the air inlet device 42 extending along this side and serving the engine through throttle bodies, indicated at 106.

The balance shaft 44 is again driven from the crankshaft, but in this instance by a crankshaft drive gear 107 that is affixed adjacent the coupling 58 but within the engine body 103. This drives a gear 108 fixed to the corresponding end of the balance shaft 44. Alternatively, the balance shaft 44 may be located on the opposite side as shown in phantom in FIG. 5.

In this embodiment, the fuel pump 61 is driven from the balance shaft drive gear 108 by means of a gear 109 fixed to its input shaft.

With this arrangement, the exhaust system 43 is disposed at the side of the engine and overlies the fuel pump 61.

Figure 8:
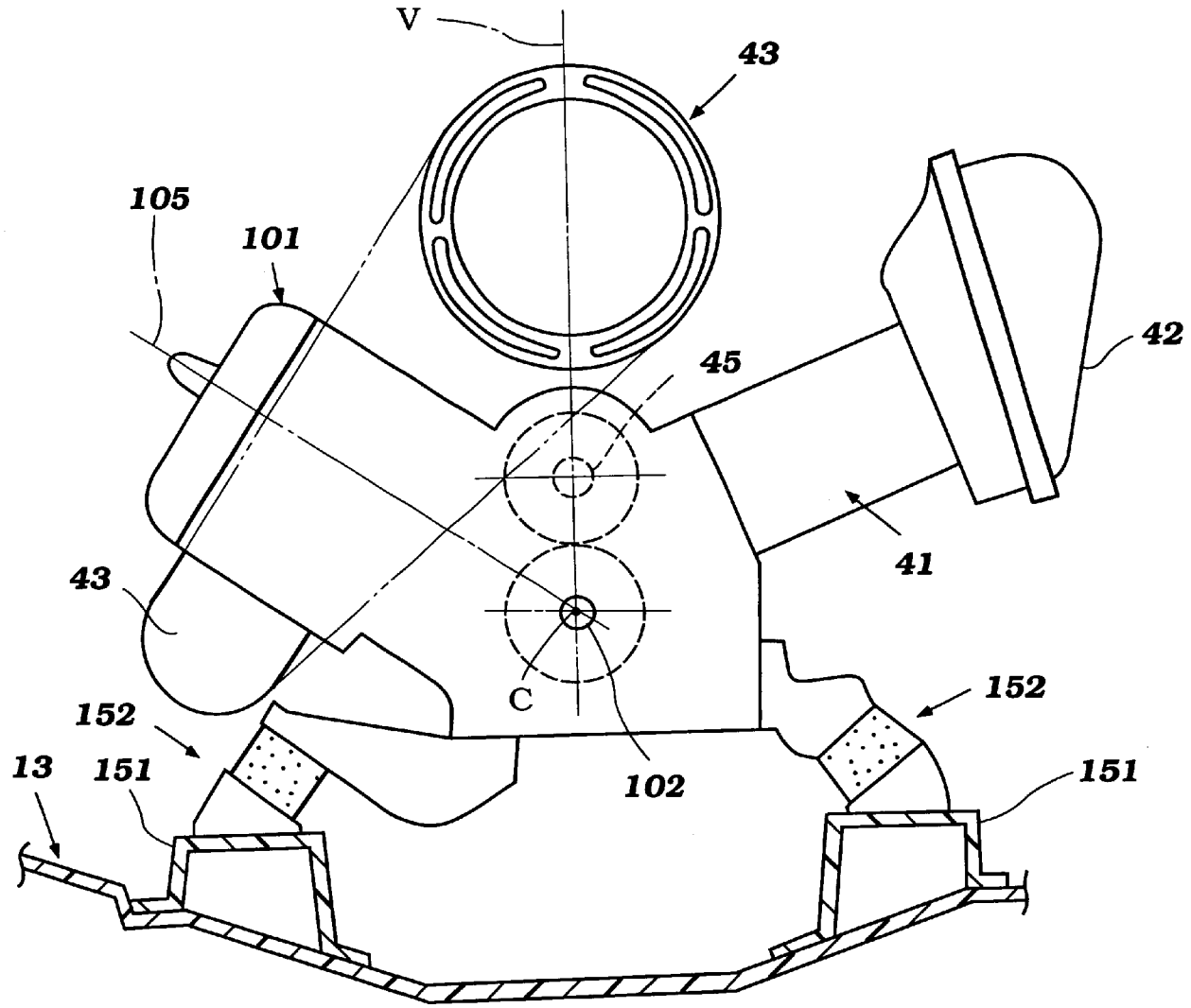
FIG. 8 is a partial transverse cross-sectional view, in part similar to FIG. 5, taken through a personal watercraft constructed in accordance with a fourth embodiment of the invention.

FIG. 8 shows another embodiment which is similar to the embodiment of FIGS. 5–6 in that the engine, again indicated by the reference numeral 101, is mounted in the hull so that its crankshaft 102 rotates about an axis that coincident with a longitudinal axis of the watercraft 11. In this embodiment, however, a lower center of gravity is obtained by putting the cylinder block 103 in a position so that it is rotated from the horizontal toward one side.

In this arrangement, therefore, the induction system 41 is oriented in approximately the same angular position as the previously described embodiment. However, the axis of rotation of the balance shaft 45 is raised so that it is placed on the vertical line V above the axis of rotation of the crankshaft 102. Thus, the exhaust system 43 is positioned on the opposite side of the engine from the intake system 41 and in part passes through the area vertically above the balance shaft 45.

This figure also shows how the engine 101 is actually mounted in the watercraft hull on the member 13. Specifically, the hull member 13 is provided with pedestals 151 upon which the engine 101 is mounted by elastic isolator assemblies 152. Therefore, this embodiment has the same advantages as those previously described and provides a somewhat lower center of gravity while still maintaining a compact construction.

Thus, from the foregoing description, it should be readily apparent that the described embodiments of the invention provide a very compact propulsion system for a personal watercraft and one which can be conveniently positioned at the desired location in the hull to maintain the desired center of gravity and which include balance shafts for minimizing the transmission of vibrations to the riders.

Of course, the foregoing description is that of preferred embodiments of the invention. Those skilled in the art will readily understand that various changes and modifications can be made without departing from the spirit and scope of the invention, as defined by the appended claims.

What is claimed is:

1. A small personal watercraft and propulsion system therefore comprised of a hull defining a riders' area at the rear thereof for accommodating a rider and a minimum number of passengers, a jet propulsion system suspended in said hull at the rear thereof and lying at least in substantial part beneath said riders' area, said jet propulsion system including an impeller shaft rotating in a plane extending longitudinally of said hull, an internal combustion engine supported within said hull at a position disposed forwardly of said jet propulsion unit at a position at least in part below the forward portion of said riders' area, said engine having an engine body defining a plurality of cylinders and a crankshaft driven by pistons reciprocating in said cylinders about an axis disposed transversely to a longitudinal center line of said hull, a transmission for driving said jet propulsion unit from the middle of said crankshaft, and a balance shaft for said engine rotatable about an axis parallel to said crankshaft axis and driven from the middle of said crankshaft and contained within said engine body.

2. The small personal watercraft and propulsion system therefore as set forth in claim 1 wherein the cylinder body includes a cylinder block that is inclined rearwardly from a vertically extending plane.

3. The small personal watercraft and propulsion system therefore as set forth in claim 2 wherein the balance shaft axis is to the front of the crankshaft axis.

4. The small personal watercraft and propulsion system therefore as set forth in claim 2 wherein the balance shaft axis is to the rear of the crankshaft axis.

5. The small personal watercraft and propulsion system therefore as set forth in claim 1 wherein the transmission includes a bevel gear transmission contained within the engine body that drives an engine drive shaft.

6. The small personal watercraft and propulsion system therefore as set forth in claim 5 wherein the engine drive shaft is coupled to the impeller shaft of the jet propulsion system.

7. The small personal watercraft and propulsion system as set forth in claim 6 wherein the balance shaft driven is by the crankshaft through a second bevel gear transmission.

* * * * *